United States Patent [19]

Figueiras

[11] 4,237,840

[45] Dec. 9, 1980

[54] UNIVERSAL SYSTEM FOR SUPPLYING GASES TO INTERNAL COMBUSTION ENGINE

[76] Inventor: Andres Figueiras, Calle L#1085 Urb. Monoz Rivera, Guaynabo, P.R. 00657

[21] Appl. No.: 29,526

[22] Filed: Apr. 12, 1979

[51] Int. Cl.[3] ..... F02B 25/06

[52] U.S. Cl. ..... 123/568; 123/572; 74/606 R

[58] Field of Search ..... 123/119 B, 119 A; 74/606

[56] References Cited

U.S. PATENT DOCUMENTS

| | | | |
|---|---|---|---|
| 1,507,950 | 9/1924 | Blizzard | 123/119 B |
| 1,511,493 | 10/1924 | Barnum | 123/119 B |
| 1,608,018 | 11/1926 | Eldred | 123/119 B |
| 3,042,014 | 7/1962 | Falzone | 123/119 A |
| 3,260,130 | 7/1966 | Pitts | 123/119 B |

*Primary Examiner*—Wendell E. Burns

*Attorney, Agent, or Firm*—Scrivener, Clarke, Scrivener and Johnson

[57] ABSTRACT

The disclosure is of a system for collecting and filtering gases and vapors produced in various parts of an internal combustion engine and combining them with fresh air and supplying the mixture to the engine with the fuel-air mixture from the carburetor to improve combustion.

1 Claim, 1 Drawing Figure

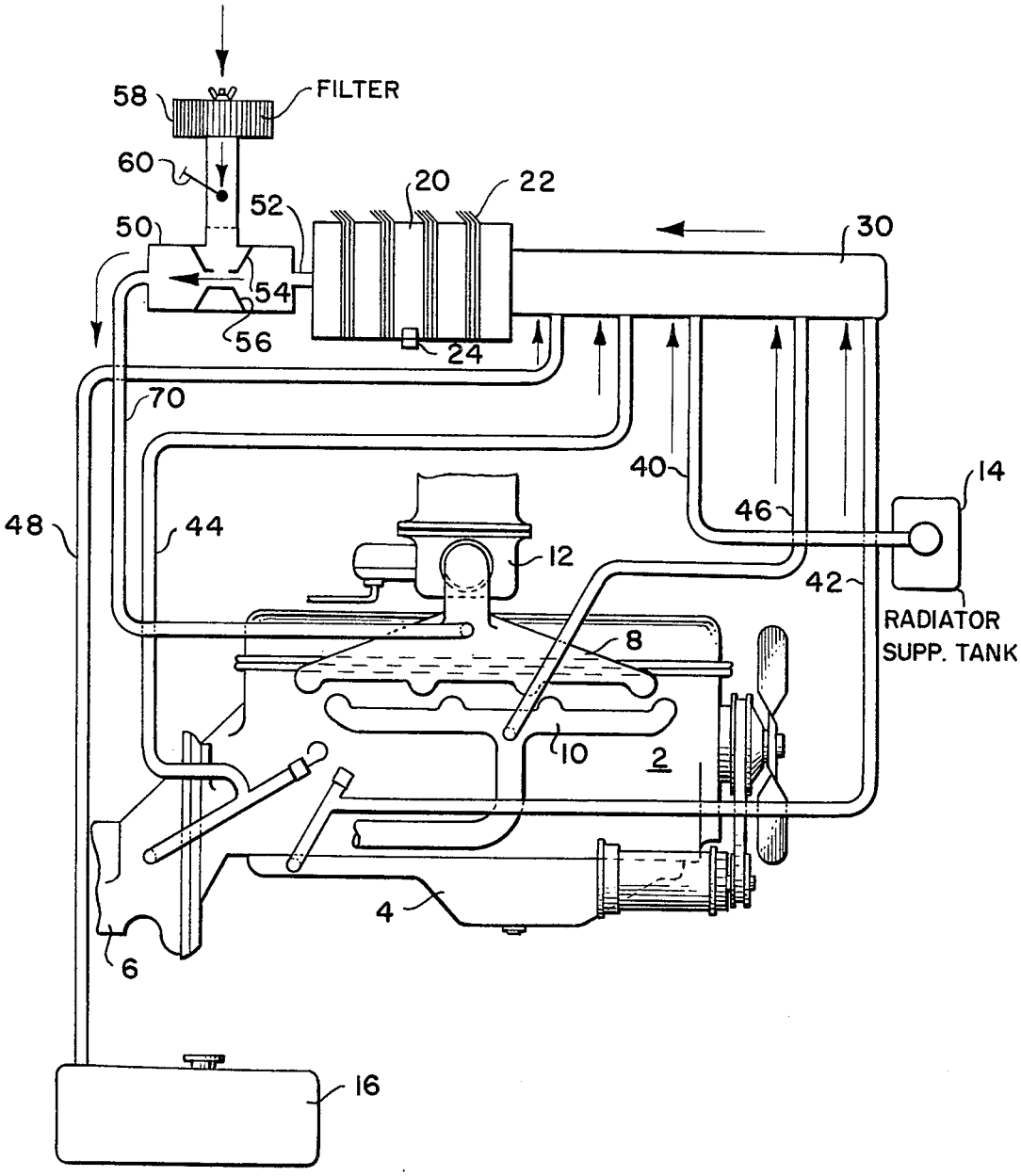
FILTER
58
60
52
20
22
50
30
54
56
24
70
40
14
46
48
44
12
42
RADIATOR
SUPP. TANK
8
10
2
4
6
16

UNIVERSAL SYSTEM FOR SUPPLYING GASES TO INTERNAL COMBUSTION ENGINE

BACKGROUND OF THE INVENTION

The U.S. Pat. Nos.: to Barlow 3,224,188, Nohira 3,774,399 and DePalma 3,846,980 describe and claim systems for supplying exhaust gas to the intake manifold of an internal combustion engine, and are representative of the best prior art pertinent to the present invention.

SUMMARY OF THE INVENTION

Gases produced in the exhaust manifold, crankcase, radiator transmission casing, and fuel tank of an internal combustion engine are filtered and supplied to the inlet manifold for combination with the fuel-air mixture supplied by the carburetor. Means are also provided for increasing the velocity of the stream of gas flowing from the filter to the inlet manifold.

DESCRIPTION OF THE DRAWINGS

The single FIGURE of the drawings is an elevational view of an internal combustion engine with the means provided by the invention.

DESCRIPTION OF THE INVENTION

An internal combustion engine of generally conventional construction and operation is illustrated and comprises the cylinder block 2 within which there are coolant passages (not shown), a crankcase 4, automatic transmission 6, intake manifold 8, exhaust manifold 10, carburetor 12, radiator supply tank 14 and fuel tank 16.

A filter chamber 20 is associated with the engine and is provided with one or more removable filter elements 22 which are so contructed that they will pass gases but remove therefrom all particulate matter which collects in the chamber and may be removed through a drain plug 24 in the lower part of the chamber.

An inlet header 30 is associated with the filter chamber and the interior of the header is connected to that of the chamber to permit the introduction of gases from the header to the chamber.

Those of the engine components described above which produce a gas during engine operation are connected to the inlet header 30 to permit the passage of gases to the header. Thus, the header is connected through tube 40 to the space above the liquid in the coolant supply tank 14, through tube 42 to the space above lubricant in crankcase 4, through tube 44 to the space above lubricant in the automatic transmission 6, through tube 46 to the exhaust manifold, and through tube 48 to the space above fuel in tank 14. These gases are propelled by the pressure in the exhaust manifold into the filter chamber 20 and through the filter elements therein, leaving particulate matter in the chamber and passing from the chamber as a clean gas.

Means are provided by the invention for adding velocity to the gas emerging from the filter chamber and combining it with the fuel-air mixture supplied by the carburetor to the intake mainfold of the engine. Such means comprises jet chamber 50 which is connected by tube 52 to the delivery side of the filter chamber to receive the gas emerging therefrom. Within the jet chamber there are provided opposed means 54, 56 which provide between them a restricted passage through which the gas delivered by the filter chamber passes, thereby increasing its velocity. One of the means, such as 54, which provides the restricted passage is hollow and connected to atmosphere through filter means 58, to thereby add atmospheric air to the gas from the filter chamber. Volume control means 60 may be provided to control the volume of atmospheric air admitted through the passage forming means 54 thereby to control the richness of the gas-air mixture. The outlet passage of the jet chamber is connected through tube 70 to the intake manifold 8 of the engine.

It will be seen that the connection of the intake manifold suction to the exhaust manifold through the jet and filter chambers will reduce the pressure in that manifold with consequent increase in the power delivered by the engine.

The increased speed of the gases also causes decrease in the operating temperature of the engine, again because the exhaust manifold is under suction which adds to the normal pressure of gas in that manifold, thus increasing the velocity of gas in the entire engine system.

I claim:

1. An internal combustion engine fuel supply system, comprising a fuel inlet manifold, a carburetor supplying a fuel-air mixture to the inlet mainfold, an exhaust manifold, a radiator within which a coolant is circulated, a crankcase having a lubricant therein, a transmission casing having a lubricant therein, a fuel tank, a filter chamber having inlet and outlet ports and filter means therein, a header chamber, means connecting the header chamber to the inlet port of the filter chamber, means connecting the header chamber to the exhaust manifold, to the radiator supply tank above the level of coolant therein, to the crankcase above the level of lubricant therein, to the transmission casing above the level of lubricant therein, and to the fuel tank above the level of fuel therein, means for connecting the outlet port of the filter chamber to the inlet manifold, means connected between the outlet port of the filter chamber and the inlet manifold for increasing the velocity of the gas passing to the inlet manifold comprising a chamber having therein a restricted passage through which gas flowing from the filter chamber to the inlet manifold must pass, and means for supplying atmospheric air to the restricted passage for mixture with the gas passing therethrough.

* * * * *